US008904998B2

(12) United States Patent
Cleeves

(10) Patent No.: US 8,904,998 B2
(45) Date of Patent: Dec. 9, 2014

(54) SLEEVE VALVE ASSEMBLY

(71) Applicant: Pinnacle Engines, Inc., San Carlos, CA (US)

(72) Inventor: James M. Cleeves, Redwood City, CA (US)

(73) Assignee: Pinnacle Engines, Inc., San Carlos, CA (US)

( * ) Notice: Subject to any disclaimer, the term of this patent is extended or adjusted under 35 U.S.C. 154(b) by 0 days.

(21) Appl. No.: 14/071,509

(22) Filed: Nov. 4, 2013

(65) Prior Publication Data

US 2014/0060468 A1 Mar. 6, 2014

Related U.S. Application Data

(62) Division of application No. 12/710,248, filed on Feb. 22, 2010, now Pat. No. 8,573,178.

(60) Provisional application No. 61/155,010, filed on Feb. 24, 2009.

(51) Int. Cl.
*F01L 5/06* (2006.01)
*F01L 7/04* (2006.01)

(52) U.S. Cl.
CPC .... *F01L 5/06* (2013.01); *F01L 7/04* (2013.01)
USPC ..... 123/312; 123/80 C; 123/81 C; 123/188.5; 123/314

(58) Field of Classification Search
USPC ..... 123/312, 314, 48 C, 48 R, 78 C, 80 C, 123/81 C, 41.31, 41.34, 41.84, 41.85, 188.5, 123/190.12, 196 R, 193.4, 193.2
See application file for complete search history.

(56) References Cited

U.S. PATENT DOCUMENTS

| | | | |
|---|---|---|---|
| 1,097,947 | A | 5/1914 | Shaw |
| 1,140,987 | A | 5/1915 | Kube |
| 1,258,524 | A | 3/1918 | Berry |
| 1,377,798 | A | 5/1921 | Berckenhoff |
| 1,550,643 | A | 8/1925 | Bullington |
| 1,673,340 | A | 6/1928 | Schaeffer |
| 1,773,971 | A | 8/1930 | Dunn |
| 1,812,323 | A | 6/1931 | Davison et al. |
| 2,090,889 | A | 8/1937 | Werner |
| 2,273,179 | A | 2/1942 | Davision |

(Continued)

FOREIGN PATENT DOCUMENTS

| | | | |
|---|---|---|---|
| JP | 62-007909 | | 1/1987 |
| JP | 2008-505282 | A | 2/2008 |
| WO | WO-2007006469 | A2 | 1/2007 |
| WO | WO-2007121086 | A2 | 10/2007 |

*Primary Examiner* — Noah Kamen
*Assistant Examiner* — Grant Moubry
(74) *Attorney, Agent, or Firm* — Mintz Levin Cohn Ferris Glovsky and Popeo, P.C.

(57) ABSTRACT

A sleeve valve assembly. The assembly includes a valve seat, a sleeve valve and an oil path-defining piece. The sleeve valve includes a distal end with a cavity. The distal end contacts the valve seat when the sleeve valve is located in a closed position. The oil path-defining piece includes an inlet port, an outlet port and a plurality of cooling passages. The flange of the sleeve valve is slidably in contact with the oil path-defining piece such that cooling fluid travelling into the inlet port and through the cooling passages enters into the cavity before exiting out the exit port.

25 Claims, 7 Drawing Sheets

(56) References Cited

U.S. PATENT DOCUMENTS

| | | | | | |
|---|---|---|---|---|---|
| 2,409,761 | A | | 10/1946 | Hulsing | |
| 3,948,241 | A | | 4/1976 | Melchior | |
| 4,050,421 | A | * | 9/1977 | Cendak | 123/41.72 |
| 4,815,421 | A | | 3/1989 | Paul et al. | |
| 4,838,214 | A | | 6/1989 | Barrett | |
| 4,928,658 | A | | 5/1990 | Ferrenberg et al. | |
| 5,054,438 | A | * | 10/1991 | Takashima | 123/50 R |
| 5,113,805 | A | | 5/1992 | Kawamura | |
| 5,803,042 | A | | 9/1998 | Bortone | |
| 6,205,963 | B1 | | 3/2001 | Davies | |
| 7,004,119 | B2 | | 2/2006 | Dardalis | |
| 7,559,298 | B2 | | 7/2009 | Cleeves | |
| 8,210,147 | B2 | * | 7/2012 | Cotton | 123/188.4 |
| 8,459,227 | B2 | * | 6/2013 | Cotton | 123/188.5 |
| 2004/0244758 | A1 | * | 12/2004 | Weng et al. | 123/193.4 |
| 2008/0115771 | A1 | | 5/2008 | Elsbett | |

* cited by examiner

SLEEVE VALVE ASSEMBLY

PRIORITY CLAIM

The present application is a divisional of Ser. No. 12/710,248, filed Feb. 22, 2010, which claims priority under 35 U.S.C. §119(e) to U.S. provisional application No. 61/155,010, entitled Sleeve Valve Assembly, which application was filed on Feb. 24, 2009, which applications are incorporated by reference herein in its entirety.

BACKGROUND

An internal combustion engine includes a sleeve valve which fits between the piston and the cylinder wall in the cylinder where it rotates and/or slides. The sleeve valve moves independently from the piston so that openings in the valve align with the inlet and exhaust ports in the cylinder at proper stages in the combustion cycle. One example of such a sleeve valve is shown in U.S. Pat. No. 7,559,298, titled "Internal Combustion Engine," which is assigned to Cleeves Engines Inc., and is incorporated in its entirety herein.

FIG. 9 illustrates a cross-sectional view of a portion of a conventional annular sleeve valve assembly 20. The sleeve valve assembly 20 includes a sleeve valve 22, an oil path-defining piece 24 and a valve seat 36. The sleeve valve 22 has a distal end 18 with an end surface 14, an inner surface 21, and an exterior surface 23. The oil path-defining piece 16 includes an oil inlet 28, a cooling passage 30, and an oil outlet 32. FIG. 9 shows the sleeve valve 22 in a closed position as the end surface 14 is in contact with the valve seat 36.

The sleeve valve 22 reciprocates between an open position and a closed position over the valve seal 26. On one side of the seal 26 is the manifold gas, either intake on one side or exhaust on the other (via port 34), and the other side of the seal 26 is cooling/lubricating oil path 27 in the oil path-defining piece 16. The combustion gases in the cylinder (not shown) heat the inner surface 21 of the sleeve valve 22 and, indirectly, the oil seal on the exterior surface 23 of the sleeve valve 22. In this embodiment, the coolant travelling through the cooling passage 30 is at least a distance t1 from the exterior surface 23 of the sleeve valve 22. A typical distance t1 is several millimeters away from the exterior surface 23 of the sleeve valve 22.

A conventional sleeve valve is often manufactured from steel. In the instance whereby the sleeve valve 22 is steel, it is very difficult to effectively cool the end surface 14 of the sleeve valve 22 during operation of the engine.

A more efficient cooling system is needed for a sleeve valve design.

SUMMARY

One aspect of the present technology is to provide a sleeve valve assembly with improved cooling features. Providing a sleeve valve assembly that allows cooling fluid to circulate near the tip of the sleeve valve is one way to maximize the cooling efficiency of the assembly. In one embodiment, the sleeve valve assembly includes a sleeve valve with a reentrant cavity at a distal end of the valve. In another embodiment, the sleeve valve assembly includes a sleeve valve having high thermal conductivity characteristics combined with cooling grooves formed in an exterior surface of the sleeve valve. In yet another embodiment, the sleeve valve assembly includes a hollow sleeve valve partially filled with a heat transfer agent.

A sleeve valve having a reentrant cavity at the tip allows cooling fluid circulating within an oil path-defining piece to travel within a close distance to the hottest portions of the sleeve valve. In operation, heat generated within the cylinder heats the inner surface of the sleeve valve. The highest temperatures within the cylinder are at a distal end of the sleeve valve, causing the distal end to be the hottest portion of the valve. The cavity at the tip of the sleeve valve allows cooling fluid to spray the inner surfaces of the valve tip. Thus, cooling fluid is separated from the hottest surfaces of the valve by only the thickness of the valve itself.

A hollow sleeve valve filled with a heat transfer agent provides additional cooling that may be required for high-performance engines. In one embodiment, the cavity in the sleeve valve is partially filled with sodium. When the sodium is subjected to the heat being transferred through the inner sleeve valve wall (from the cylinder), the sodium liquefies and begins to slosh around in the cavity. The liquid sodium draws heat from the inner wall of the sleeve valve. An oil path-defining piece circulates cooling fluid along an exterior wall of the sleeve valve. Cooling fluid flowing along the exterior wall of the sleeve valve draws heat from the exterior wall of the sleeve valve. It also conducts heat to the oil path defining piece.

A sleeve valve with high thermal conductivity characteristics provides a higher heat flux for drawing heat from the hot end of the sleeve valve. In one embodiment, the sleeve valve may comprise an aluminum sleeve valve. Aluminum has a high thermal conductivity and hence is able to dissipate heat quicker than, for example, steel. To reduce the mass of an aluminum sleeve valve and to increase the surface area for cooling, axial grooves are formed in an exterior surface of the sleeve valve. The oil path-defining piece circulates cooling fluid through these grooves.

One embodiment of the present technology is to increase the life of a sleeve valve. In one embodiment, a hardened insert is placed over the sleeve valve. Alternatively, a coating is placed over the tip of the sleeve valve. The insert or coating preferably has a higher hardness than the sleeve valve material itself. The insert and/or coating will prevent or slow down the wear of the sleeve valve. An insert may include impact absorbing features to distribute the impact forces received from the valve seat over a greater surface area.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Figure 1:
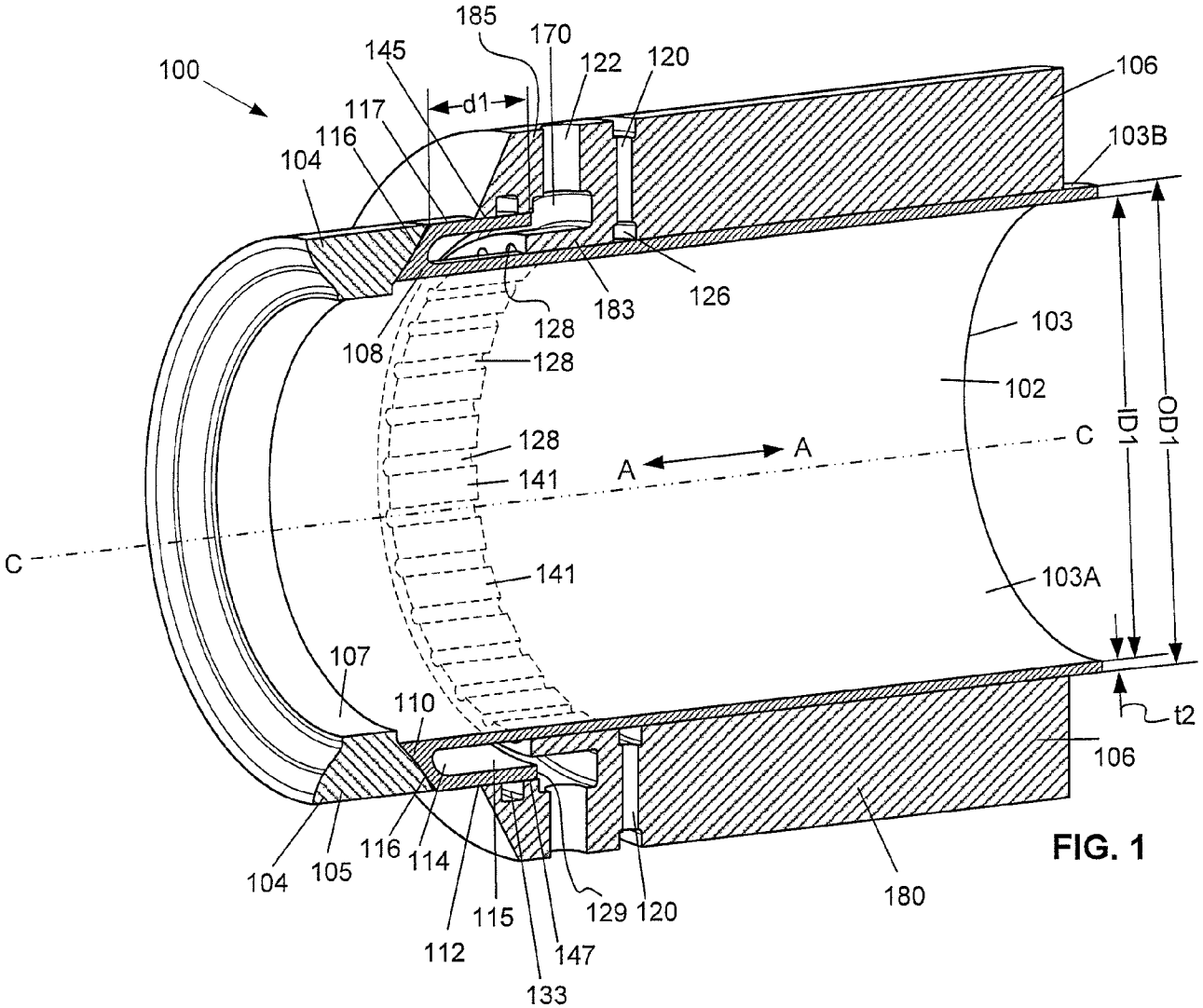
FIG. 1 is a cut-away isometric view of a sleeve valve assembly, with a sleeve valve shown in a closed position.

The present technology will now be described in reference to FIGS. 1-8 and 10-14. FIG. 1 illustrates a sleeve valve assembly 100. The sleeve valve assembly 100 includes a sleeve valve 102, a central connecting piece 104 and an oil path-defining piece 106. In FIG. 1, the sleeve valve 102 is shown in a closed position as the end surface 110 of the sleeve valve 102 is in contact with the valve seat 116.

The sleeve valve 102 includes a sleeve portion 103, an end surface 110 and a flange 112. The sleeve portion 103 includes an inner surface 103A and an exterior surface 103B. The sleeve portion 103 is cylindrical in shape, having an outside diameter OD1, an inside diameter ID1 and an axial centerline C-C. The thickness or width t2 of the sleeve portion 103 is therefore half the distance between the outside diameter OD1 and the inside diameter ID1.

In the FIG. 1 embodiment, the sleeve portion 103 includes a distal end 108 (also referred to as the "top end" or "tip") that transitions into the end surface 110 and flange 112. As will be discussed in more detail later, the end surface 110 forms a seal with the valve seat 116 when the sleeve valve 102 is in a closed position. The flange 112 extends a distance d1 rearward from the end surface 110, and includes an interior surface 115 and an exterior surface 117. A cavity 114 is formed in the sleeve valve tip between the sleeve portion 103 and the flange 112. In particular, the cavity 114 is defined by the area between the exterior surface 103B of the sleeve portion 103, an inner wall 119 (see FIGS. 4 and 5) of the sleeve valve tip and the inner surface 115 of the flange 112. FIG. 1 illustrates that the thickness t2 of the sleeve portion 103 is slightly less than the thickness of the sleeve tip and the flange 112. It is within the scope of the technology for the sleeve portion 103, the sleeve tip and the flange 112 to have a uniform width or that the flange 112 could be thin relative to sleeve portion 103.

The central connecting piece 104 is in the form of a ring having an outer portion 105 and an inner portion 107. The central connecting piece 104 includes spark plug sleeves (not shown), through which spark plugs can be inserted. The central connecting piece 104 further defines the valve seat 116. An air inlet or exit port 10 (shown in FIG. 4) is defined between the central connecting piece 104 on one side and a cylinder block (not shown) on the other side.

The oil path-defining piece 106 provides two main functions for the sleeve valve assembly 100: it defines a cooling fluid path for circulating cooling fluid (e.g., oil) through the assembly, and it acts as a guide for both the sleeve portion 103 and the flange 112. The cooling fluid path in the oil path-defining piece 106 is defined by an inlet port 120, a circumferential grove 126, axial grooves 128, a collector 170 and an outlet port 122. The inlet port 120 allows the cooling fluid to enter the oil path-defining piece 106 and travel towards the exterior surface 103B of the sleeve portion 103. Cooling fluid exits the port 122 into the collector 170. The circumferential groove 126 allows the cooling fluid to distribute around the circumference of the sleeve portion 103 along its exterior surface 103B. The axial grooves 128 are provided in a first guide ring 183. The grooves 128 provide a path from the circumferential groove 126 to the cavity 114. The first guide ring 183 generally provides a surface for the exterior surface 103B of the sleeve portion 103 to slide along and prevent radial motion of the sleeve valve 102 (motion orthogonal to arrows A-A). Additional detail of the first guide ring 183 will be provided later herein with reference to FIG. 3.

The oil path-defining piece 106 also includes a second guide ring 185. The second guide ring 185 includes a seal groove 133 between two surfaces 145, 147. The second guide ring 185 can provide a guide surface for the flange 112. In the instance whereby the second guide ring 185 does provide a guide surface for the flange 112, it is within the scope of the technology for either surface 145 or surface 147 to provide a guide surface for the flange 112. Alternatively, both surfaces 145 and 147 can provide a guide surface for the flange 112. A seal within the seal groove 133 prevents cooling fluid from leaking in to the port 10. Additional detail of the second guide ring 185 will be provided later herein with reference to FIG. 3.

The sleeve valve 102 is slidably movable to the right and the left relative to the oil path-defining piece 106, as shown by arrows A-A. Movement of the sleeve valve 102 to the right (from the FIG. 1 perspective) opens the port 10. Movement of the sleeve valve 102 to the left closes the port 10, and the end surface 110 of the sleeve valve 102 forms a seal with the valve seat 116.

If FIG. 1 represents the sleeve valve closed during ignition, the internal volume of the sleeve valve 102 has been filled with pressurized air and fuel, typically vaporized petroleum. The fuel is ignited, which causes combustion, and an increase in pressure within the internal volume of the sleeve valve 102. At this instance, the sleeve portion 103 is subjected to the highest pressure and temperatures during the cycle. In particular, the sleeve tip or distal end 108 is subjected to the highest temperatures. After ignition, the internal volume of the cylinder expands (piston moves to the right, not shown) due to the increased pressure of combustion. The expansion causes a reduction in pressure and temperature within the internal volume of the sleeve valve 102. Thus, the temperature gradient that the inner surface 103A of the sleeve portion 103 is subjected to is hottest at the distal end 108 and the temperature of the inner surface 103A lessens down the sleeve portion 103 (away from the distal end 108). Accordingly, circulating cooling fluid over the hottest portion of the sleeve valve 102 (e.g., distal end 108) provides efficient cooling.

In operation, the cooling fluid is effectively sprayed or jetted from the grooves 128 into the cavity 114. Thus, the cooling fluid contacts or covers the exterior surface 103B of the sleeve portion 103, the inner surface 119 (FIGS. 4 and 5) of the tip of the valve 102 and the inner surface 115 of the flange 112 before the cooling fluid drains out of the cavity 114 into the collector 170 (and eventually exiting out the port 122). The cooling fluid within the cavity 114 is therefore separated from the inner surface 103A of the sleeve portion 103 by only the thickness t2 of the sleeve portion 103. By way of example only, the thickness t2 of the sleeve portion 103 may comprise a distance between 1-3 mm. Similarly, the cooling fluid within the cavity 114 is separated from the end surface 110 of the valve 102 by only the thickness of the sleeve tip. The cavity 114 provided in the sleeve valve tip drastically reduces the distance between the cooling fluid and the hottest portions of the sleeve valve 102; greatly increasing the heat transfer rate of the assembly 100 over conventional sleeve valve designs.

FIG. 1 illustrates that the flange 112 extends rearward from the end surface 110 a distance d1. The length d1 of the flange 112 may vary. As will be described in more detail later, the flange 112 provides several functions. The exterior surface 117 of the flange 112 is slidably in contact with the second contact surface 147 of the second guide ring 185 of the oil path-defining piece 106. The exterior surface 117 of the flange 112 is preferably not in slidable contact with the first contact surface 145 as there is no lubrication between the exterior surface 117 of the flange 112 and the first contact surface 145. To prevent cooling fluid from leaking out from the collector 170 along the exterior surface 117 of the flange 112 into the port 10, a seal 130 (shown in FIG. 5) is seated with a channel 133 located between the first and second contact surfaces 145, 147.

Figure 2:
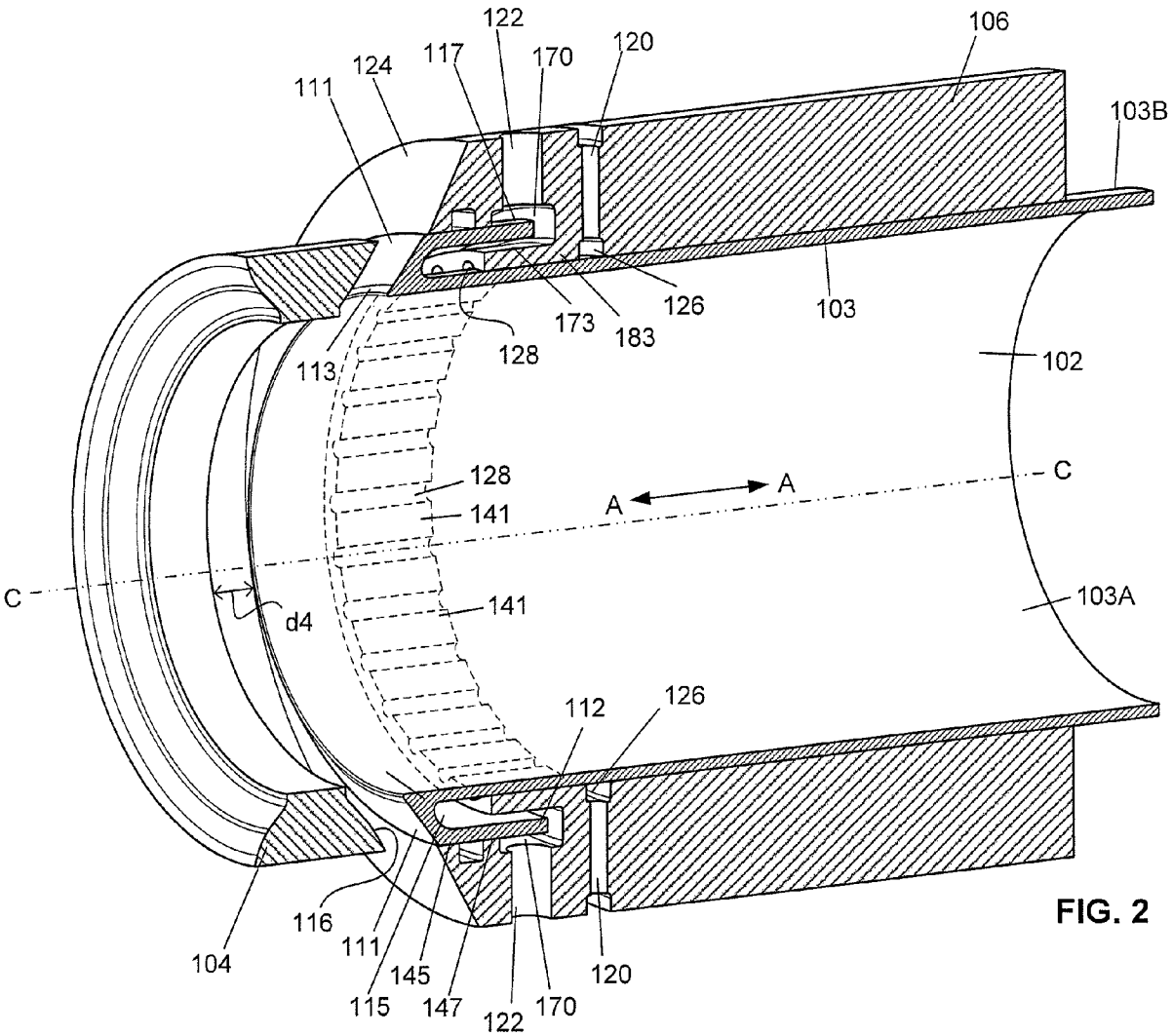
FIG. 2 is a cut-away isometric view of the sleeve valve assembly shown in FIG. 1, with a sleeve valve shown in an open position.

FIG. 2 illustrates the sleeve valve 102 in an open position. As shown in FIG. 2, the sleeve valve 102 has moved rearward a distance d4 away from the valve seat 116. The seal 130 maintains contact with the exterior surface 117 of the flange 112 as the sleeve valve 102 moves rearward. As the sleeve valve 102 moves rearward, the distal end 108 of the sleeve valve 102 moves towards the seal 130. As discussed above, the distal end 108 is a hot portion of the sleeve valve 102 during operation of the engine. Thus, the seal 130 travels over a hotter portion of the sleeve valve 102 as it opens. By way of example only, the seal 130 is within 1 to 3 mm of the end surface 110 when the valve 102 is located in the open position shown in FIG. 2 (as opposed to approximately 1.5 cm away when the valve 102 is located in the closed position shown in FIG. 1). These distances are exemplary only.

The length d1 of the flange 112 should be long enough so that the flange 112 always remains in contact with the seal 130. In the instance where the first guide ring 183 provides the guide surface (e.g., guide off exterior surface 103*b* of the sleeve portion 103), surfaces 145 and 147 likely will not contact the exterior surface 117 of the flange 112. Instead, the surface 145 is proximate to the exterior surface 117 of the flange 112 to minimize or prevent exhaust gas from exiting and surface 147 is proximate to the exterior surface 117 of the flange 112 to support and locate the seal 130 of the second guide ring 185. The flange 112 should not be so long that the rim 119 (FIGS. 4 and 5) of the flange 112 contacts the rear wall 171 of the collector 170 when the valve 102 is located in the open position (FIG. 2). FIG. 2 also illustrates that a gap exists between the inner surface 115 of the flange 112 and the bottom surface 173 of the collector 170 to allow the cooling fluid to flow during all aspects of operation of the sleeve valve 102 and to prevent mechanical damage to the assembly. Additional details of the cooling fluid path are provided herein with regard to FIGS. 4-8.

FIG. 2 illustrates that the end surface 110 includes a first surface 111 and a second surface 113. As will be discussed in more detail later, the shape or configuration of the end surface 110 preferably mirrors the shape of the valve seat 116.

Figure 3:
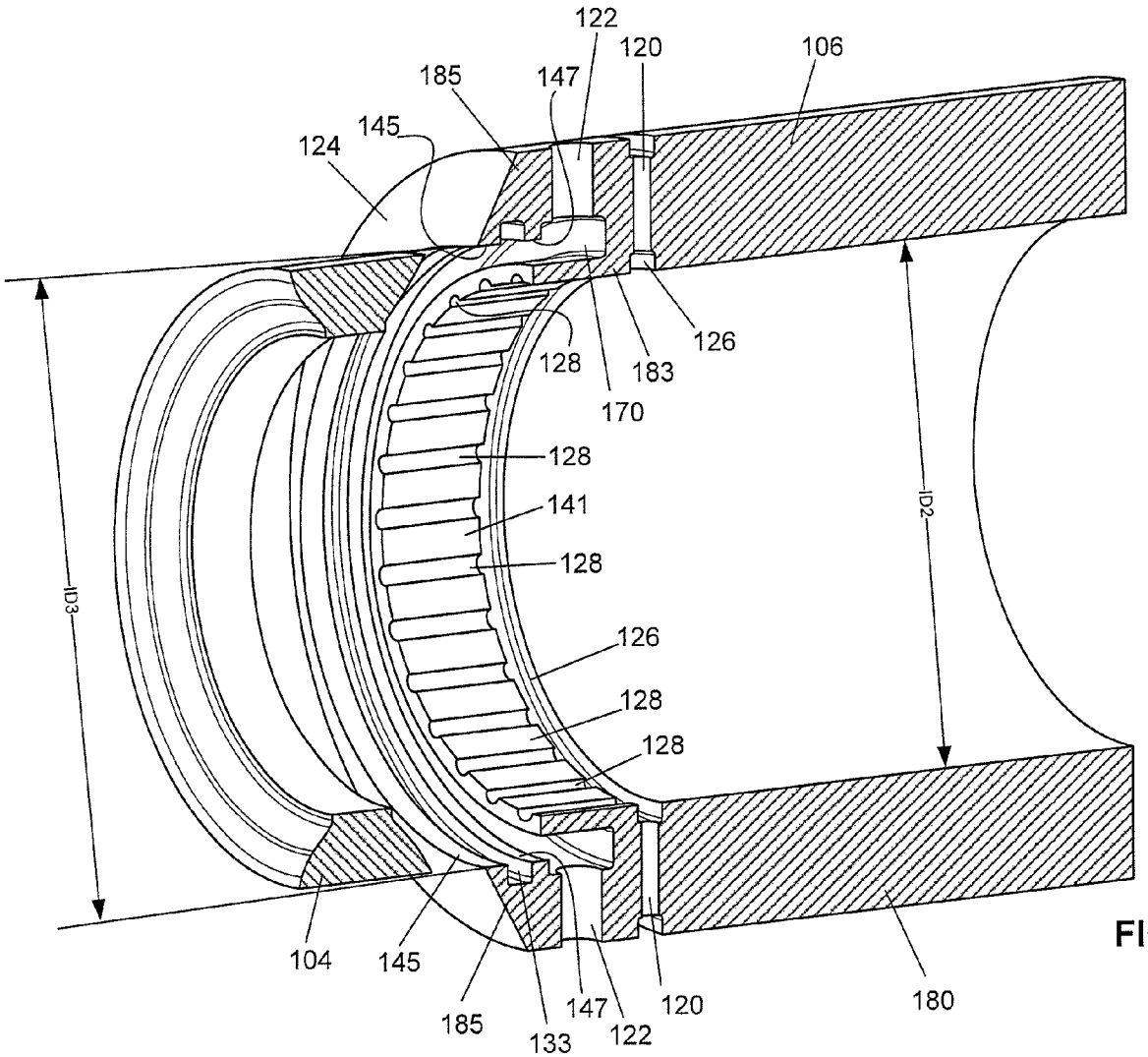
FIG. 3 is a cut-away isometric view of an oil path-defining piece.

FIG. 3 provides additional detail of the oil path-defining piece 106. FIG. 3 illustrates that the oil path-defining piece 106 includes a body 180, a first guide ring 183 and a second guide ring 185. The body 180 includes the inlet port 120, which allows the cooling fluid to travel into the circumferential groove 126. The body 180 also defines a collector 170 and the outlet port 122. The first guide ring 183 includes multiple cooling grooves 128, each having an inlet 128A and an outlet 128B. Cooling fluid that enters the circumferential groove 126 exits into the cooling grooves 128. The raised surfaces 141 formed between the grooves 128 provide a guide surface for the exterior surface 103B of the sleeve portion 103 as the valve 102 moves between an open position and a closed position. The raised surfaces 141 also act as a flow restrictor to insure that cooling fluid distributes around the circumferential groove 126 and subsequently passes through the cooling grooves 128 with enough velocity to impinge on the inner surface 119 of end wall 110. The cooling grooves 128 provide a path for the cooling liquid to travel from the circumferential groove 126, along the exterior surface 103B of the sleeve valve portion 103, and into the cavity 114 in the distal end 108 of the sleeve valve 102. The first guide ring 183 has an inside diameter substantially equal to the outside diameter OD1 of the sleeve portion 103.

FIG. 3 illustrates one configuration of the cooling grooves 128 in the guide ring 183. The cooling grooves 128 are not limited to the FIG. 3 configuration. The guide ring 183 may include more (or fewer) cooling grooves 128 than shown in FIG. 3, and the cooling grooves 128 may comprise a different shape (e.g., square cross-section, etc.). The grooves 128 may also have a larger or smaller diameter than that shown in FIG. 3. The length of the grooves 128 may also vary. The grooves 128 shown in FIG. 3 are axially aligned with respect to the centerline C-C of the sleeve valve 102. The grooves 128 may also be oriented at an angle with respect to the centerline C-C of the sleeve valve 102.

The second guide ring 185 provides guidance for the flange 112. The inside diameter of the guide ring 185 is preferably substantially similar to the outside diameter of the flange 112. As discussed above, the guide ring 185 also maintains a seal with the exterior surface 117 of the flange 112 (via seal 130) to prevent cooling fluid from leaking into the port 10.

Figure 4:
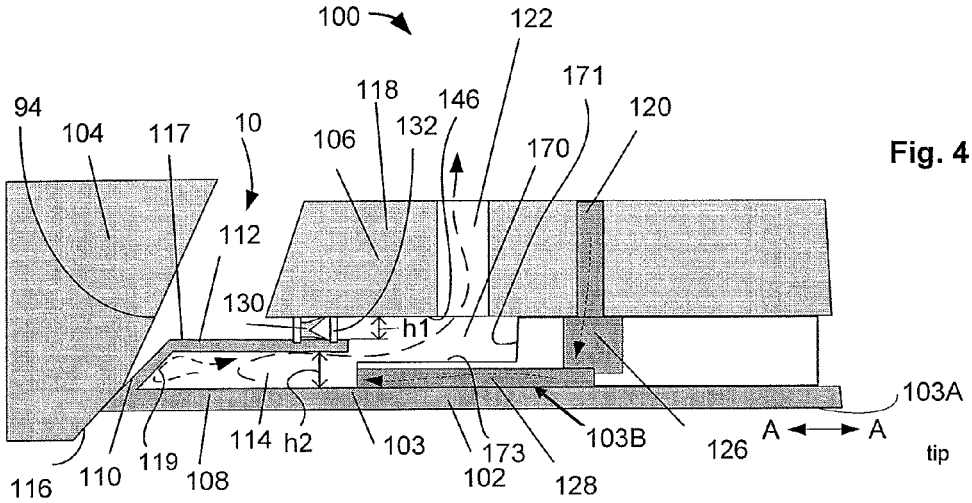
FIG. 4 is a cross-sectional side view of another embodiment of a sleeve valve assembly.

FIGS. 4-8 illustrate various configurations of a sleeve valve and oil path-defining piece. FIG. 4 illustrates a variation of the sleeve valve assembly 100 shown in FIGS. 1-2, with the sleeve valve 102 in a closed position. In the FIG. 4 configuration, the exterior surface 117 of the flange 112 does not directly contact the surface 146 of the oil path-defining piece 106 during operation. In addition, the seal 130 travels with the flange 112 to remain a fixed distance from the end surface 110 of the sleeve valve 102.

FIG. 4 illustrates that two protrusions 132 extend upward from the exterior surface 117 of the flange 112. The distal end of each protrusion 132 is proximate to the surface 146 of the oil path-defining piece 106. In one embodiment, the distal ends of the protrusions 132 have clearance with the surface 146 and support the seal seated between the protrusions 132.

One advantage of the FIG. 4 configuration is that the seal 130 remains a fixed distance from the end surface 110 of the sleeve valve 102. As the sleeve valve 102 opens (moves to the right), the seal 130 moves to the right with the flange 112. Thus, the seal 130 does not slide over the hottest portion of the flange 112 (towards the end surface 110). Exposing the seal 130 to high temperatures may degrade the life of the seal 130. Thus, maintaining the seal 130 a fixed distance from the end surface 110 of the sleeve valve 102 may increase the life of the seal 130. Each protrusion 132 has a height h1. The height h1 of the protrusions 132 reduces the available height h2 of the cavity 114; effectively decreasing the volume of the cavity 114.

FIG. 4 illustrates that the cooling fluid flows (shown by dashed-lines with arrows) within the sleeve valve assembly 100 from right to left as the fluid enters the inlet port 120 and exits the outlet port 122 (from the FIG. 4 perspective). Alternatively, the fluid flow can be reversed (e.g., inlet port 120 and outlet port 122 are reversed). FIG. 4 also illustrates that the thickness of the sleeve portion 103 is greater than the thickness of either the tip of the valve or the flange 112. As discussed above, the sleeve portion 103 likely requires a greater thickness to provide adequate stiffness characteristics. As the cooling fluid sloshes within the cavity 114, the cooling fluid is cooling the exterior surface 103B of the sleeve portion 103, the inner surface 115 of the flange 112 and the inner surface 119 of the sleeve tip.

Figure 5:
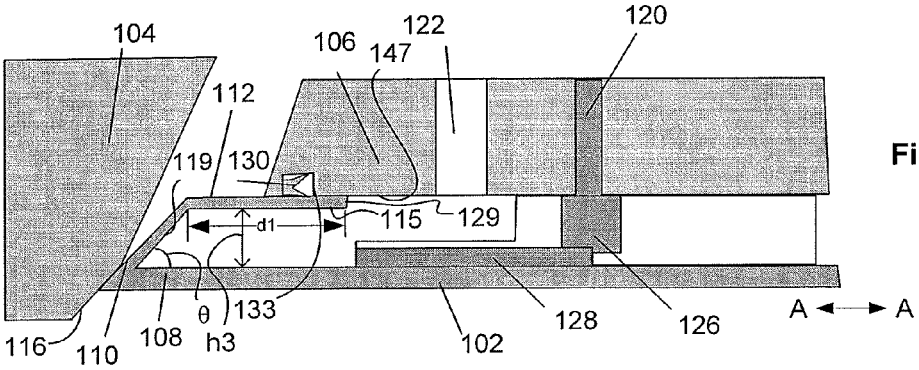
FIG. 5 is a cross-sectional side view of the sleeve valve assembly shown in FIG. 1, providing additional detail of the distal end of the sleeve valve.

FIG. 5 provides additional detail of the sleeve valve 102, connecting piece 104 and oil path-defining piece 106 shown in FIGS. 1-2. FIG. 5 illustrates the sleeve valve 102 in a closed position, whereby the end surface 110 of the sleeve valve 102 is in contact with the valve seat 116. FIG. 5 illustrates that the inner wall 119 of the sleeve tip forms an angle θ with the exterior surface 103B of the sleeve portion 103. The angle θ may comprise any angle between 30-90 degrees, and in one embodiment comprises 45 degrees. FIG. 5 also illustrates the height h3 of the cavity 114. The increased height of the cavity causes the exterior surface 117 of the flange 112 to form a seal with the surfaces 145, 147 of the oil path-defining piece 106. The height h3 shown in FIG. 5 is larger than the height h2 shown in FIG. 4 because the gap h1 that existed between the flange 112 and the oil path-defining piece 106 has been eliminated. Increasing the volume of the cavity 114 increases the amount of cooling fluid that may circulate through the cavity 114. Increased circulation of cooling fluid in the sleeve valve tip provides better cooling characteristics of the assembly shown in FIG. 5 (e.g., removes more heat from the sleeve portion 103 exposed to the high temperatures within the cylinder) and allows less restrictive drains.

The seal 130 seated in the channel 133 is stationary, and does not move with the flange 112. As the sleeve valve 102 moves to an open position (see FIG. 6), the exterior surface 117 of the flange 112 travels over the seal 130. Bringing the distal end 108 of the flange 112 closer to the seal 130 subjects the seal 130 to higher temperatures because, as discussed above, the flange 112 is hottest at the distal end 108.

Figure 6:
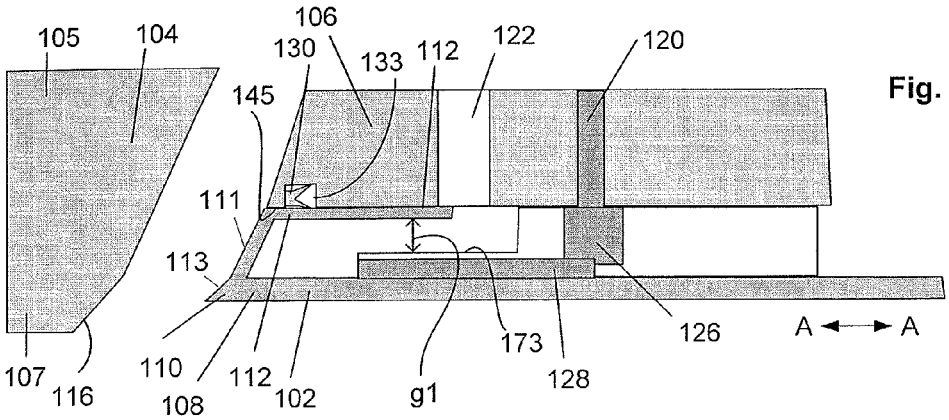
FIG. 6 is a cross-sectional side view of the sleeve valve assembly as in FIG. 5, but with the sleeve valve shown in an open position.

FIG. 6 illustrates that a gap g1 is maintained between the inner surface 115 of the flange 112 and the bottom surface 173 of the collector 170 when the sleeve valve 102 is located in the open position. The gap g1 allows the cooling fluid to exit from the cavity 114, into the collector 170, and exit via the port 122. In one embodiment, the gap g1 comprises a distance between 1-3 mm. The gap g1 may vary, and comprise other distances as well.

Figure 7:
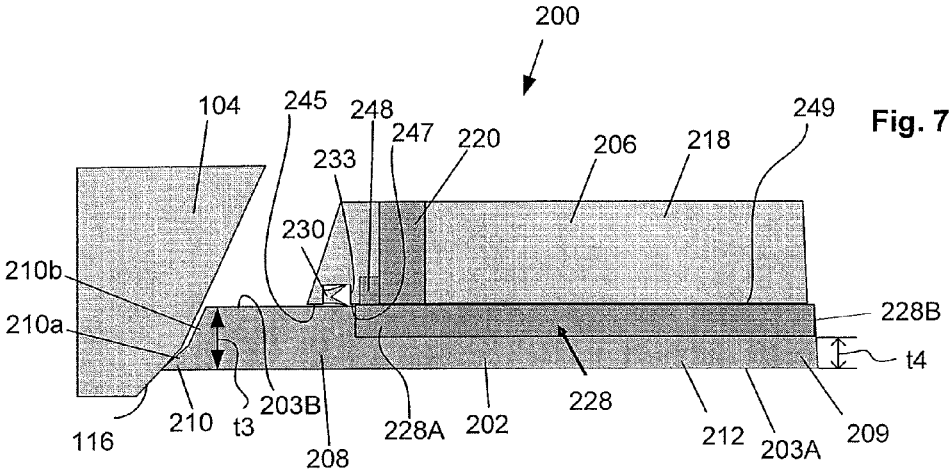
FIG. 7 is a cross-sectional side view of another embodiment of a sleeve valve assembly, whereby the sleeve valve is shown in a closed position.

FIG. 7 illustrates another embodiment of a sleeve valve assembly. The sleeve valve assembly 200 shown in FIG. 7 includes a sleeve valve 202, a connecting piece 104 and an oil path-defining piece 206. The connecting piece 104 is substantially similar to the configuration shown in FIG. 4-6, whereby the connecting piece 104 includes a valve seat 116.

The sleeve valve 202 includes a top or distal end 208 and a second end 209, and has an inner surface 203A and an exterior surface 203B. The distal end 208 of the sleeve valve 202 forms an end surface 210, which forms a seal with the valve seat 116, as shown in FIG. 7. The end surface 210 includes a first section 210*a* and a second section 210*b*. The first section 210*a* may be located radially inward of the second section 210*b* (i.e., closer to the central axis C, FIG. 1). The first section 210*a* may be provided at an oblique angle with respect to the central axis, and may mate with a portion of seat 116 having a similarly formed oblique angle. The respective angles of the portion 210*a* and seat 116 may be approximately the same. Alternatively, the angle of the first portion 210*a* may be more oblique than the angle of the corresponding portion of the seat 116 so that, when the first portion 210*a* mates against that portion of the seat 116, the radially innermost tip of portion 210*a* contacts the seat 116 first.

Providing the seal at a radially inner portion of the seat limits the area of end surface 210 exposed to the combustion gas pressure. Gas pressure on end surface 210 tends to lift the valve off the seat. In particular, if the seal is made radially farther out between end surface 210 and seat 116, it increases the force with which the gas attempts to push the valve away from the seat. Thus, providing the seal between the seat 116 and a radially innermost portion of end surface 210 reduces the force with which the distal end 208 is biased away from the seat 116. A spring may be used to bias the sleeve valve and hold the distal end 208 against the seat 116. Providing the seal at a radially inner diameter of the end surface 210 reduces the force with which the spring needs to hold the sleeve valve against the seat 116. The seal may be made anywhere along the interface between the end surface 210 and the seat 116 in further embodiments. The distal end 208 has a thickness or width t3 and the second end of the valve 202 has a thickness or width t4, which is thinner than the thickness t3 of the distal end 108. As shown in FIG. 7, the distal end 208 does not have a cavity in the sleeve tip.

The oil path defining piece 206 includes one or more inlet ports 220 and a circumferential groove 248. The circumferential groove 248 allows the cooling fluid to distribute around the circumference of the sleeve portion 203 along its exterior surface 203B. The oil defining piece 206 further includes a seal groove 233. A seal 230 is seated within the groove 233, and is located between a first surface 245 and a second surface 247. The seal 230 prevents cooling fluid from leaking between the exterior surface 203B of the sleeve valve 202 and the second surface 245 into the port 10.

The exterior surface 203B of the sleeve valve 202 has been machined to create axial grooves 228 around the circumference of the valve 202. Each groove has a first end 228A and a second end 228B. Using the first guide ring 183 as an example (shown in FIG. 3), the exterior surface 203B of the sleeve valve 202 appears similar to the first guide ring 183; the exterior surface 203B of the sleeve valve 202 has multiple grooves 228 with raised surfaces like 141 between the grooves 228. The exterior surface 203B of the valve 202 is in slidable contact with the surfaces, 247 and 249 of the oil path-defining piece 206.

Compared to the FIG. 4-6 embodiments of a sleeve valve with a cavity 114 in the tip of the valve, the sleeve valve 202 shown in FIG. 7 does not have any means for distributing the cooling fluid as close to the distal end 208 of the sleeve valve 202. A valve with a solid tip also potentially creates a valve having a larger mass. The sleeve valve 202 shown in FIG. 7 likely comprises a lighter material than the sleeve valves shown in FIGS. 4-6 to offset the larger mass of the distal end 208 (and maintain a substantially similar weight). In one embodiment, the sleeve valve 202 is aluminum. The mass of an aluminum sleeve valve 202 (as shown in FIG. 7) is substantially the same as the mass of a steel sleeve valve 102

(with FIG. 4 configuration) even though the weight of the distal end 208 of the valve 202 is likely greater than the tip of the sleeve valve 102.

The material stiffness of aluminum is one-third that of steel. Thus, the thickness t3 of the distal end of the sleeve valve needs to be substantially three times greater than the thickness of a steel sleeve valve. However, because the mass of aluminum is approximately one-third that of steel, the resultant sleeve valve is the same weight as a steel sleeve valve. There are several advantages using aluminum over steel. Aluminum conducts heat approximately two times better than steel. Thus, an aluminum sleeve valve having a distal end with a thickness t3 removes six times as much heat as a steel sleeve valve having a thickness t2. In addition, the sleeve portion 212 can be machined away to form fins to increase the surface area away from distal end 208. Reducing the thickness of the sleeve portion 212 is possible because the pressure inside the cylinder is lower as the piston moves away from the distal end 208. The fins help transfer more heat into the cooling fluid.

To lighten the mass of the sleeve valve 202, FIG. 7 illustrates that a portion of the exterior surface 203B has been removed to form cooling grooves 228; reducing the thickness of a portion of the valve 202 with a thickness t4. The length of the cooling grooves 228 may vary. FIG. 7 illustrates that, when the sleeve valve 202 is in a closed position, the cooling grooves 228 do not extend into the seal 230. In other words, the exterior surface 203B of the sleeve valve 202, at the distal end 208, always remains in contact with the seal 230 during operation.

Cooling fluid travels into the inlet port 220 in the oil path-defining piece 206 and into a first end 228A of the cooling grooves 228. The cooling fluid travels within the cooling grooves 228 towards a second end 228B of the cooling grooves 228, which provides an outlet port for the cooling fluid. Forming cooling passages 228 into the exterior surface 203B of the sleeve valve 202 brings the cooling fluid as close as possible to the inner surface 203A of the sleeve valve 202, which is the surface that is subjected to the highest heat from within the cylinder. Reducing the distance t4 to a minimum acceptable distance reduces the distance the heat from within the cylinder must travel before being exposed to the cooling fluid. The same is true with respect to the distal end 208 of the valve 202, which is subjected to the highest temperatures within the cylinder The distal end 208 of the sleeve valve 202 is subjected to the higher pressures from within the cylinder than the body portion 209 of the sleeve valve 202. A sleeve valve 202 with a thicker distal end 208 provides the higher stiffness characteristics required at the distal end 208. In the instance of an aluminum sleeve valve 202 (instead of steel), the thickness t4 of the sleeve valve 202 may have to be greater than the thickness t2 of the sleeve portion 103 of a conventional sleeve valve for stiffness reasons. For example, the thickness t4 of an aluminum sleeve valve may be required to be approximately three times thicker than the thickness t2 of the sleeve portion 103 shown in FIG. 1. The thickness t4 of the sleeve valve 202 may vary. The sleeve valve 202 may comprise other high thermal conductivity materials such as, but not limited to, copper berilium, metal matrix composites, various Al alloys, and the like.

One advantage of an aluminum sleeve valve is that aluminum has a significantly higher thermal conductivity than steel. Even though the surface area exposed to the heat within the cylinder (area of inner surface 203A) is equal to the surface area of the valve 102 shown in FIG. 1, in combination with the larger cross-sectional area of the valve 202, more heat can be drawn out of the sleeve valve 202. One disadvantage of aluminum is the material's low hardness at high temperatures. This material property of aluminum might lead to excessive wear of the end surface 110 from the valve seat 116, reducing the life of the sleeve valve 202.

An insert or coating may be placed over the end surface 210 of the sleeve valve 202 (or sleeve valve 102) to prevent excessive wear of the end surface 210. Additional details of inserts and coating will be provided later herein in reference to FIG. 10-14.

Figure 8:
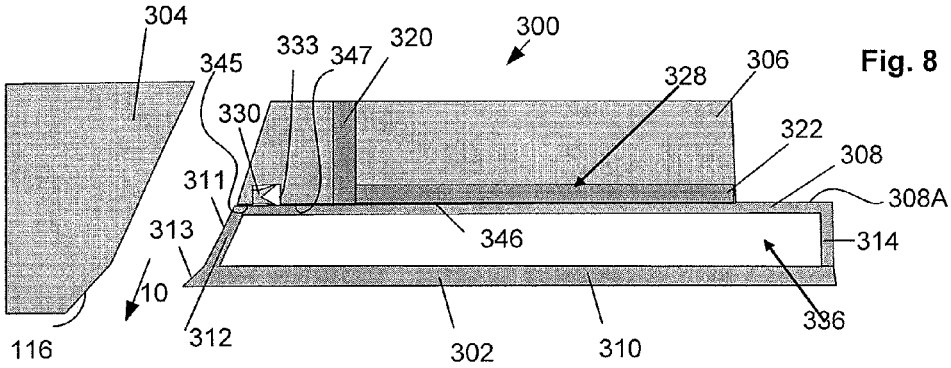
FIG. 8 is a cross-sectional side view of another embodiment of a sleeve valve assembly, with the sleeve valve shown in an open position.
Figure 9:
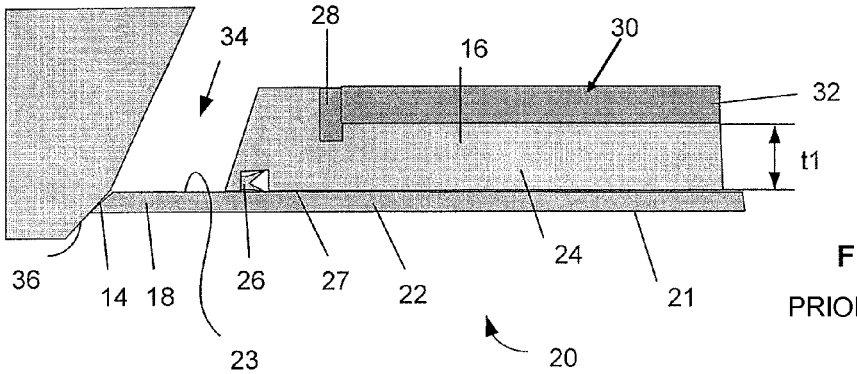
Fig. 9 PRIOR ART
FIG. 9 is a cross-sectional side view of a sleeve valve assembly according to the prior art, whereby the sleeve valve is shown in a closed position.

FIG. 8 illustrates a sleeve valve assembly 300. The sleeve valve assembly 300 includes a sleeve valve 302, a connecting piece 304 and an oil path-defining piece 306. The sleeve valve 302 shown in FIG. 8 is hollow. The valve 302 has a cavity 336 defined by an exterior wall 308, an inner wall 310, a first end wall 312 and a second end wall 314. The first end wall 312 includes an exterior surface 316 having a first surface 311 and a second surface 313. The connecting piece 304 defines a valve seat 116.

The oil path-defining piece 306 includes an inlet port 320, cooling grooves 328 and an exit port 322. The oil path-defining piece 306 further includes a circumferential groove 333 (shown with a seal 130 seated in the groove 333) in between first and second surfaces 345, 347. Using the FIG. 3 example of the guide ring 183, the portion of the oil path-defining piece 306 with grooves 328 may appear similar to the guide ring 183 (e.g., grooves 328 are machined into an interior surface 346 of the oil path-defining piece 306). In this instance, the exterior surface 308A of the exterior wall 308 is in slidable contact with the interior surface 346 of the oil path-defining piece 306. The portion of the oil path-defining piece 306 with the surfaces 345, 347 and the groove 333 may appear similar to the surfaces 145*m* 147 and groove 133 shown in FIG. 3. In this case, the exterior surface 308A is in slidable contact with the surfaces, 347, and the seal 330 prevents oil from leaking out into the port 10.

The sleeve valve 302 is shown in an open position in FIG. 8. As shown in FIG. 8, the seal 330 travels over the distal end 308 of the valve 302 when the valve 302 moves to the open position. As discussed above, the distal end of a valve is the hottest portion of the valve and therefore, the seal 330 in FIG. 8 will be subjected to the higher temperatures of the valve 302. The cooling fluid travelling through the grooves 328 does not travel particularly close to the distal end 308 or the inner wall 310 of the valve 302.

However, the cavity 336 within the sleeve valve 302 valve is partially filled with a material that has good heat transfer characteristics and is liquid at operating temperatures. One such material that could partially fill the cavity 336 is sodium. In this instance, the sodium within the cavity 336 transforms into a liquid form when exposed to the heat of the inner wall 310, and begins to slosh back and forth in the cavity 336 as the sleeve valve 302 moves between the open and closed positions. The molten or liquid sodium draws heat from the inner wall 310 and the first end wall 312 of the valve 302. Sodium is one exemplary material, and is not intended to limit the scope of this technology. Other materials may partially fill the cavity 336 of the sleeve valve 302.

The molten sodium within the cavity 336 transfers heat to each of the walls of the valve 302. The cooling liquid travelling within the grooves 328 is in direct contact with the exterior wall 308 of the valve 302. Thus, the cooling fluid draws heat out of the exterior wall 308 and creates a heat differential that draws heat from the molten sodium metal towards the exterior wall 308. One instance whereby the sleeve valve assembly 300 shown in FIG. 8 is applicable is use in high-performance engines. The sleeve assembly 300 may be used in other engines as well.

FIGS. 10-14 illustrate various embodiments of inserts and coatings to enhance the durability of a sleeve valve. The sleeve valve shown in FIGS. 10-14 generally coincides with sleeve valve 202 shown in FIG. 7. Sleeve valve 202 is exemplary only, and is not intended to limit the scope of the technology described herein. The inserts and coatings described herein may be used in conjunction with any other sleeve valves.

In general, the repeated opening and closing of a sleeve valve causes the end surface 210 or valve tip to repeatedly slam into the valve seat 116. This repeated contact with the valve seat 116 causes the end surface 210 to wear and deform over time. Eventually, the end surface 210 will not form an effective seal with the valve seat 116 when the sleeve valve 202 is located in the closed position. Two components contributing to the wear of a sleeve valve are (i) the speed at which the sleeve valve slams into the valve seat, and (ii) the hardness of the sleeve material. The repeated impacts of the sleeve valve against the valve seat causes rubbing/scraping of the two surfaces (surface 213 of for example FIG. 10 and valve seat 116 of for example FIG. 4) and/or incrementally compacts the material itself.

Figure 10:
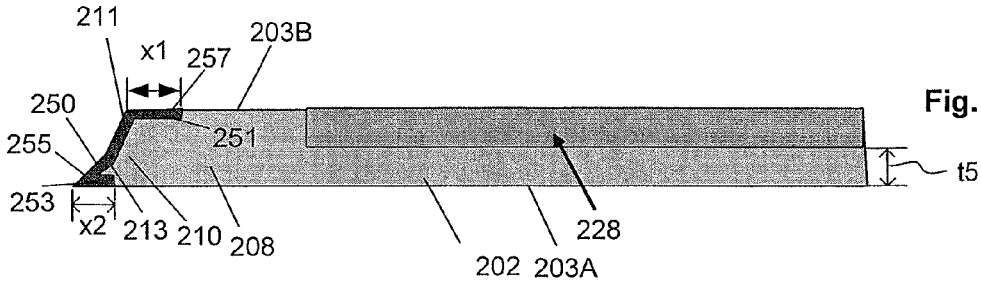
FIG. 10 is a cross-sectional side view of the sleeve valve shown in FIG. 7 with another embodiment of an insert at the distal end of the sleeve valve.

FIG. 10 illustrates an insert 250 that is placed completely over the end surface 210, and partially over the surfaces 203A and 203B of the sleeve valve 202 shown in FIG. 7. The insert 250 forms a hardened sleeve tip having an exterior member 251 and an interior member 253. The insert 250 may be affixed to the sleeve valve 202 by several different methods including, but not limited to, cast in place, swaged forged shrink fit (e.g., assemble when hard material is hot and Al is very cold), and the like. In one embodiment, the surfaces 211, 213, 203A and 203B have been machined in preparation for the insert 250; forming a seat to place the insert 250 within. Alternatively, the insert 250 may be affixed directly over the surfaces 211 and 213. The front of the insert 250 shown in FIG. 10 mirrors the surfaces 211 and 213 of the sleeve valve 202. Thus, in the FIG. 10 embodiment, the contact surface 255 of the insert 250 forms a seal with the valve seat 116 when the valve 202 is located in a closed position.

The insert 250 preferably comprises a material having a hardness sufficient to withstand the repeated impact with the valve seat 116 without deforming the surface 255. By way of example only, carbon steel may comprise one such material. Other materials may include, but are not limited to, tool steels, traditional poppet valve steel or titanium alloys, copper berilium, and the like.

The insert 250 wraps around the end surface 210 of the valve 202 to form the exterior member 251. The exterior member 251 extends a distance X1 along the outer surface 203B of the sleeve valve 102. By way of example only, the distance X1 may comprise a distance between 1 mm-10 mm. The surface 257 of the exterior member 251 is preferably flush with the exterior surface 203B so as to not interfere with the range of motion of the sleeve valve 202 during operation. For example, if the sleeve valve 202 shown in FIG. 10 replaces the sleeve valve shown in FIG. 6, it is preferable that the insert 250 does not interfere with the sleeve valve's ability to move the fully-open position shown in FIG. 6 (e.g., the surface 257 of the insert 250 should not be raised and strike the oil path-defining piece 106). The inner member 253 of the insert 250 extends along the inner surface 203A of the sleeve valve 202 by a distance X2. The distance X2 may comprise any distance. By way of example only, the distance X2 comprises between 1 mm-3 mm. FIG. 10 shows that the distance X2 is shorter than the distance X1, but this is not a required feature of the insert 250.

As discussed above, the surface 255 of the insert will be repeatedly slammed into the valve seat 116 at high speeds. This subjects the surface 255 to high impact forces. Extending the insert 250 along the exterior surface 203B and along the inner surface 203A increases the total surface area of the insert 250 (as opposed to simply covering the end surface 210 with the insert 250). Increasing the surface area of the insert 250 distributes the impact forces (from striking the valve seat) received by the surface 255 over a larger area, which provides more area for impact energy dissipation and interference of retention. FIG. 10 illustrates that the insert 250 has a uniform thickness. Alternatively, one or more of the surface of the insert 250 may comprise a different width or surface area.

Figure 11:
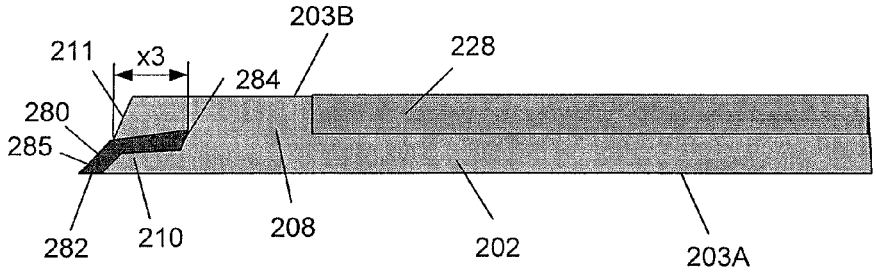
FIG. 11 is a cross-sectional side view of the sleeve valve shown in FIG. 7 with another embodiment of an insert at the distal end of the sleeve valve.

FIG. 11 illustrates another embodiment of an insert 280. The insert 280 includes a first member 282 and a second member 284. The first member 282 of the insert 280 has a distal end surface 285 which effectively replaces the contact surface 213 of the sleeve valve 202 shown in FIG. 7. The distal end surface 285 of the first member 282 is flush with the inner surface 203A of the sleeve valve 202, but could be extended like FIG. 14. The surface 211 of the sleeve valve 202, which does not contact the valve seat 116, is not covered by the insert 280 so that the wrap around of 211 provides retention of 280. The second member 284 of the insert 280 extends inward into the distal end 208 of the sleeve valve 202 a distance X3. The distance X3 may vary.

The second member 284 of the insert 280 increases the total surface area of the insert 280, which distributes the impact forces received by the insert 280 over a larger area (as opposed to the insert 280 simply covering the surface 113) and provides more area for the impact forces to dissipate. One advantage to the insert 280 shown in FIG. 11 is that the insert 280 does not extend along the exterior surface 203B of the valve 202. Thus, the insert 280 cannot interfere with the operation of the valve 202 (e.g., the insert 280 will not strike the oil path-defining piece 106 or interfere with the seal staying smoothly in contact with one surface).

Figure 12:
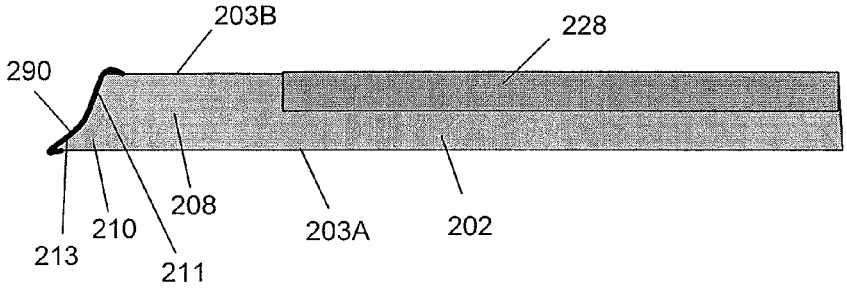
FIG. 12 is a cross-sectional side view of the sleeve valve shown in FIG. 7 with a coating covering the distal end of the sleeve valve.

FIG. 12 illustrates a sleeve valve 202 with a coating 290 on the end surface 210. In one embodiment, the coating 290 comprises a chrome plating. Alternatively, the end surface 210 may be anodized to form an aluminum oxide coating. Other materials that may be used include, but are not limited to, Nikasil, diamond like carbon, flame sprayed hard metal, ceramic materials, and the like.

FIG. 12 illustrates that the coating 290 completely covers the end surface 210 of the sleeve valve 202 (e.g., the first surface 211 and the second surface 213). Alternatively, the coating 290 may be formed over only the surface 213, which is the surface that strikes the valve seat 116. Similar to the inserts discussed above, the coating 290 is preferably a harder material than the sleeve valve 202 itself to increase the life of the sleeve valve 202. The coating 290 is intended to prevent or slow down the wear of the sleeve valve 202 due to the constant rubbing and/or scraping between the end surface 210 of the sleeve valve 202 and the valve seat 116 during operation. The thickness of a coating may vary, and is dependent on the type of coating material. By way of example only, an anodized coating may comprise 1-10 microns while a plated or sprayed material may comprise up to 100 to 200 microns.

Figure 13:
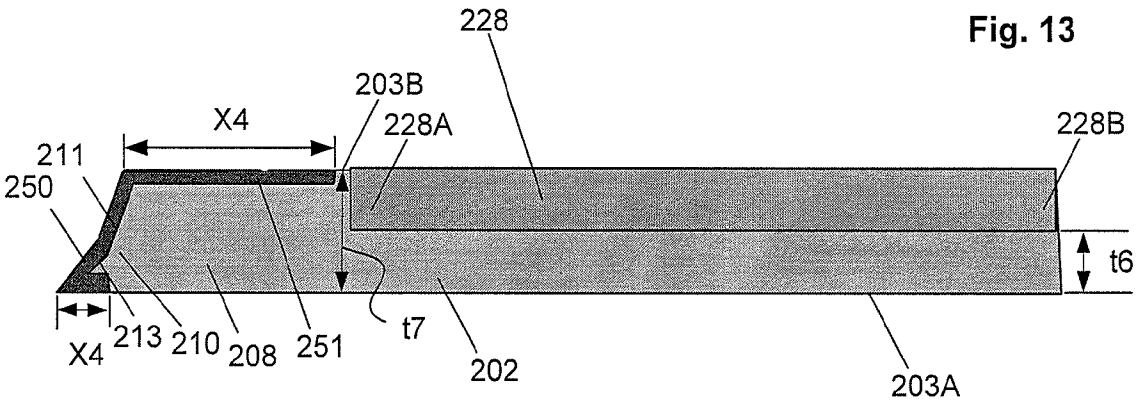
FIG. 13 is a cross-sectional side view of the sleeve valve shown in FIG. 7 with another embodiment of an insert at the distal end of the sleeve valve.

FIG. 13 illustrates another embodiment of the insert 250 shown in FIG. 10. In FIG. 13, the top member 251 of the insert 250 extends along the exterior surface 203B of the sleeve valve 202 by a distance X4. The distance X4 is greater than the distance X2 shown in FIG. 10. In one embodiment, the top member 251 of the insert 250 extends along substantially the entire exterior surface 203B of the sleeve valve 202 up to the groove 228.

One advantage of the insert 250 shown in FIG. 13 is that the top member 251 of the insert 250 covers the entire (or substantially the entire) contact surface between the sleeve valve 202 and the seal of the oil path-defining piece 206 (shown in FIG. 7). In operation, a sleeve valve 202 without the insert 250, experiences wear along the exterior surface 203B due to the sliding contact with the seal of the oil path-defining piece 206. Adding the insert 250 shown in FIG. 13 places a harder surface (top member 251) in slidable contact with the seal of the oil path-defining piece 206. This harder surface 251 will not wear at the same rate as the sleeve material, if at all; effectively extending the life of the sleeve valve 202.

Figure 14:
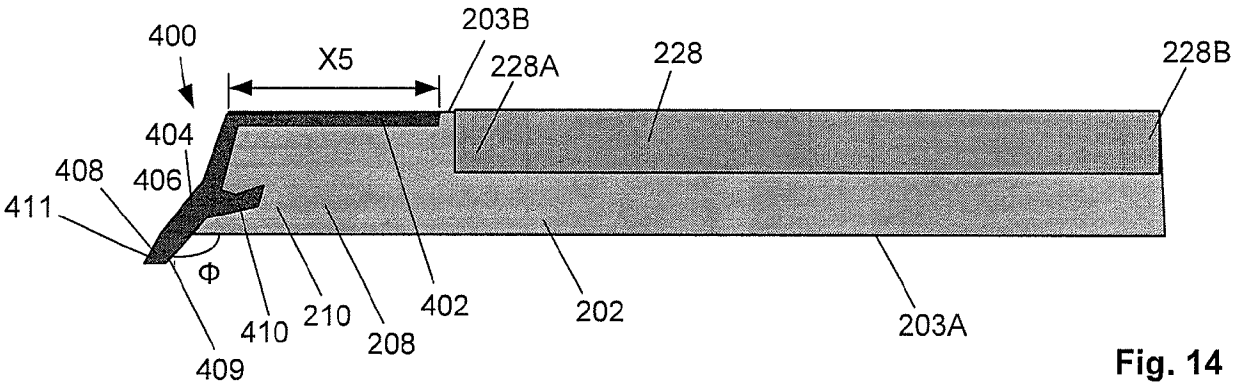
FIG. 14 is a cross-sectional side view of the sleeve valve shown in FIG. 7 with yet another embodiment of an insert at the distal end of the sleeve.

FIG. 14 illustrates an insert 400. In FIG. 14, the insert 400 includes an exterior member 402, a front member 404 and an impact energy absorbing structure 410. The top member 402 extends along the exterior surface 203B of the sleeve valve 202 a distance X5. Similar to FIG. 13, the top member 402 extends along substantially the entire exterior surface 203B of the sleeve valve 202 up to the groove 228. The front member 404 defines a contact surface 408 that forms a seal with the valve seat 116 when the sleeve valve 202 is located in a closed position.

FIG. 14 shows that the front member 404 includes a tip 408 that extends down into the cylinder and protrudes out past the inner surface 203A of the sleeve valve 202. The distance the front member 404 extends into the cylinder may vary. By way of example only, the distance may comprise between 1-10 mm. FIG. 14 also illustrates that the front member 404 of the insert 400 forms an angle Φ with respect to the inner surface 203A of the sleeve valve. The angle Φ may comprise any angle between 15-55 degrees, and in one embodiment comprises 45 degrees. The tip 408 includes an inner surface 409 and an outer surface 411, and forms a lip at the distal end 208 of the sleeve valve 202. When the piston (not shown) compresses air within the combustion chamber, with the sleeve valve 202 in a closed position, a positive pressure differential is created between the inner surface 409 and the outer surface 411 of the tip 408. The positive pressure differential further assists in keeping the tip 408 sealed against the valve seat 116.

The impact energy absorbing structure 410 increases the total surface area of the insert 400. As described above, increasing the total surface area of an insert helps to distribute and dissipate the impact forces received from the valve seat 116 impacting the insert.

The foregoing detailed description of the inventive system has been presented for purposes of illustration and description. It is not intended to be exhaustive or to limit the inventive system to the precise form disclosed. Many modifications and variations are possible in light of the above teaching. The described embodiments were chosen in order to best explain the principles of the inventive system and its practical application to thereby enable others skilled in the art to best utilize the inventive system in various embodiments and with various modifications as are suited to the particular use contemplated. It is intended that the scope of the inventive system be defined by the claims appended hereto.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A sleeve valve assembly for an internal combustion engine, comprising:

a cylindrical sleeve valve at least in part defining a combustion chamber of the internal combustion engine, the cylindrical sleeve valve capable of reciprocation along a central axis between a closed position and an open position, the cylindrical sleeve valve comprising a distal tip that seals a port when the cylindrical sleeve valve is in the closed position; and a plurality of grooves defining a plurality of fluid flow paths for a fluid between an inlet port and an outlet port, wherein the fluid flowing in the plurality of grooves directly contacts an exterior surface of the cylindrical sleeve valve, wherein the exterior of the cylindrical sleeve valve and at least one other engine component form the plurality of grooves, the cylindrical sleeve valve reciprocating relative to the at least one other component between the open position and the closed position.

2. The sleeve valve assembly as in claim 1, wherein the plurality of grooves are oriented along axes parallel to the central axis along which the cylindrical sleeve valve reciprocates.

3. The sleeve valve assembly as in claim 1, wherein the plurality of grooves are oriented along axes forming oblique angles to the central axis along which the cylindrical sleeve valve reciprocates.

4. The sleeve valve assembly as in claim 1, wherein the cylindrical sleeve valve includes a flange spaced radially outward from and surrounding an end portion of the cylindrical sleeve valve, the flange and end portion defining a cavity adjacent the distal tip, the fluid flow path including the cavity to draw heat from the distal tip.

5. The sleeve valve assembly as in claim 1, further comprising a cylindrical fluid path-defining piece at least partially surrounding the cylindrical sleeve valve, the fluid path-defining piece comprising the inlet port, the outlet port, and a cylindrical guide ring positioned between the inlet port and outlet port, the cylindrical guide ring comprising the plurality of grooves.

6. The sleeve valve assembly as in claim 5, wherein the cylindrical guide ring comprises a first guide ring, and the fluid path-defining piece further comprises a second guide ring, a portion of the flange sliding against the second guide ring, and the end portion of the cylindrical sleeve valve sliding against the first guide ring.

7. The sleeve valve assembly as in claim 6, further comprising a seal between the flange and the second guide ring, the seal preventing fluid from the fluid path-defining piece from escaping from between the fluid path-defining piece and the sleeve valve.

8. The sleeve valve assembly as in claim 1, wherein the distal tip comprises an insert for reducing wear on the distal tip.

9. The sleeve valve assembly as in claim 8, wherein the insert comprises at least one of carbon steel, hardened steel, titanium alloys, and copper beryllium.

10. The sleeve valve assembly as in claim 1, wherein the distal tip comprises a coating for reducing wear on the distal tip.

11. The sleeve valve assembly as in claim 10, wherein the coating comprises at least one of chrome plating anodized aluminum oxide, Nikasil, diamond like carbon, flame sprayed hard metal, and a ceramic material.

12. The sleeve valve assembly as in claim 1, wherein the distal tip seals the port by contacting a valve seat.

13. The sleeve valve assembly as in claim 1, wherein the plurality of grooves comprises a circumferential groove.

14. A method comprising:

reciprocating a cylindrical sleeve valve along a central axis between a closed position and an open position, the cylindrical sleeve valve at least in part defining a combustion chamber of an internal combustion engine;

sealing a port with a distal tip of the cylindrical sleeve valve when the cylindrical sleeve valve is in the closed position; and cooling the sleeve valve by flowing a fluid through a fluid flow path defined by an inlet port, an outlet port, and a plurality of grooves defining a plurality of fluid flow paths for a fluid between an inlet port and an outlet port, wherein the fluid flowing in the plurality of grooves directly contacts an exterior surface of the cylindrical sleeve valve, wherein the exterior of the cylindrical sleeve valve and at least one other engine component form the plurality of grooves, the cylindrical sleeve valve reciprocating relative to the at least one other component between the open position and the closed position.

15. The method as in claim 14, wherein a cylindrical fluid path-defining piece comprises the inlet port, the outlet port, and a cylindrical guide ring positioned between the inlet port and outlet port, the cylindrical guide ring comprising the plurality of grooves, the cylindrical fluid path-defining piece at least partially surrounding the cylindrical sleeve valve.

16. The method as in claim 15, wherein the cylindrical guide ring comprises a first guide ring, and the fluid path-defining piece further comprises a second guide ring, a portion of the flange sliding against the second guide ring, and the end portion of the cylindrical sleeve valve sliding against the first guide ring.

17. The method as in claim 16, further comprising a seal between the flange and the second guide ring, the seal preventing fluid from the fluid path-defining piece from escaping from between the fluid path-defining piece and the sleeve valve.

18. The method as is claim 14, wherein the plurality of grooves are oriented along axes parallel to the central axis along which the cylindrical sleeve valve reciprocates.

19. The method as is claim 14, wherein the plurality of grooves are oriented along axes forming oblique angles to the central axis along which the cylindrical sleeve valve reciprocates.

20. The method as is claim 14, wherein the cylindrical sleeve valve includes a flange spaced radially outward from and surrounding an end portion of the cylindrical sleeve valve, the flange and end portion defining a cavity adjacent the distal tip, the fluid flow path including the cavity to draw heat from the distal tip.

21. The method as is claim 14, wherein the sealing comprises contacting the distal end with a valve seat.

22. The method as is claim 14, wherein the distal tip comprises an insert for reducing wear on the distal tip.

23. The method as is claim 22, wherein the insert comprises at least one of carbon steel, hardened steel, titanium alloys, and copper beryllium.

24. The method as is claim 14, wherein the distal tip comprises a coating for reducing wear on the distal tip.

25. The method as is claim 24, wherein the coating comprises at least one of chrome plating anodized aluminum oxide, Nikasil, diamond like carbon, flame sprayed hard metal, and a ceramic material.

* * * * *